US007295795B2

(12) United States Patent
Suzuki et al.

(10) Patent No.: US 7,295,795 B2
(45) Date of Patent: Nov. 13, 2007

(54) IMAGE FORMING APPARATUS AND AN IMPURITY COLLECTING DEVICE ASSOCIATED WITH REGISTRATION ROLLERS

(75) Inventors: Koji Suzuki, Kanagawa (JP); Hideaki Mochimaru, Kanagawa (JP); Naoki Iwata, Saitama (JP); Kunihiko Tomita, Kanagawa (JP); Hiroshi Yokoyama, Kanagawa (JP); Norimasa Sohmiya, Saitama (JP); Shigeru Watanabe, Kanagawa (JP); Chiemi Kaneko, Ibaraki (JP); Yasukuni Omata, Kanagawa (JP); Hisao Murayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/237,773

(22) Filed: Sep. 29, 2005

(65) Prior Publication Data

US 2006/0024095 A1 Feb. 2, 2006

Related U.S. Application Data

(63) Continuation of application No. 10/424,077, filed on Apr. 28, 2003, now Pat. No. 7,003,251.

(30) Foreign Application Priority Data

Apr. 26, 2002 (JP) ..... 2002-125544

(51) Int. Cl.
*G03G 15/08* (2006.01)

(52) U.S. Cl. ..... 399/121; 399/99

(58) Field of Classification Search ..... 399/297, 399/301, 302, 303, 307, 308, 309, 388.394, 399/98, 99, 101, 121, 124
See application file for complete search history.

(56) References Cited

U.S. PATENT DOCUMENTS 4,684,238 A * 8/1987 Till et al. ..... 399/308
4,688,925 A 8/1987 Randall
4,750,018 A * 6/1988 Gooray et al. ..... 399/390

(Continued)

FOREIGN PATENT DOCUMENTS

JP 62-193243 8/1987

(Continued)

OTHER PUBLICATIONS

U.S. Appl. No. 11/563,544, filed Nov. 27, 2006, Taguma et al.

*Primary Examiner*—Robert Beatty
(74) *Attorney, Agent, or Firm*—Oblon, Spivak, McClelland, Maier & Neustadt, P.C.

(57) ABSTRACT

An image forming method begins with a first image transfer step for thermally transferring a first toner image from a first image carrier to a second image carrier contacting it. Subsequently, in a second image transfer step, the first toner image carried on the second image carrier and a second toner image newly formed on the first image carrier are thermally transferred to opposite sides of a recording medium substantially at the same time. Higher image transfer temperature is assigned to the second image transfer step than to the first image transfer step. An impurity collecting device is associated with a pair of registration rollers which stop the recording medium for a moment to thereby synchronize the recording medium to the toner image.

1 Claim, 8 Drawing Sheets

U.S. PATENT DOCUMENTS 4,763,167 A * 8/1988 Watanabe et al. ..... 347/155
5,070,371 A 12/1991 Randall
5,124,756 A 6/1992 Stelter
5,410,392 A 4/1995 Landa
5,420,662 A 5/1995 Gerstner
5,614,997 A * 3/1997 Marumoto ..... 399/121
5,740,498 A * 4/1998 Tsuchiya ..... 399/98
5,839,032 A * 11/1998 Yasui et al. ..... 399/124
5,882,828 A 3/1999 Kato et al.
6,078,775 A 6/2000 Arai et al.
6,088,565 A 7/2000 Jia et al.
6,115,568 A * 9/2000 Sameshima ..... 399/110
6,240,265 B1 5/2001 Noh
6,266,499 B1 * 7/2001 Murata et al. ..... 399/98
6,415,119 B2 * 7/2002 Nishimura et al. ..... 399/98
6,487,388 B2 11/2002 Theodoulou et al.
6,505,019 B2 * 1/2003 Sato et al. ..... 399/98
6,529,259 B1 3/2003 Kono
6,574,448 B2 * 6/2003 Mochimaru et al. ..... 399/309
6,584,295 B2 * 6/2003 Omata et al. ..... 399/306
6,600,895 B2 7/2003 Fletcher et al.
6,604,461 B1 8/2003 De Bock et al.
6,608,985 B2 * 8/2003 Mochimaru et al. ..... 399/309
6,633,733 B2 * 10/2003 Mochimaru et al. ..... 399/45
6,643,489 B2 * 11/2003 Omata et al. ..... 399/309

FOREIGN PATENT DOCUMENTS

JP 04-129940 A 4/1992
JP 04246045 A * 9/1992
JP 5-64866 8/1993
JP 6-118733 4/1994
JP 6-508444 9/1994
JP 06336348 A * 12/1994
JP 8-137183 5/1996
JP 9-197763 7/1997
JP 10-198113 7/1998
JP 10203672 A * 8/1998
JP 10-301400 11/1998
JP 11-84900 3/1999
JP P2000-250272 A 9/2000
JP P2001-350357 A 12/2001
JP P2002-040720 A 2/2002
JP P2002-087712 A 3/2002

* cited by examiner

IMAGE FORMING APPARATUS AND AN IMPURITY COLLECTING DEVICE ASSOCIATED WITH REGISTRATION ROLLERS

CROSS-REFERENCE TO RELATED APPLICATIONS

This application is a continuation of U.S. application Ser. No. 10/424,077 filed Apr. 28, 2003 now U.S. Pat. No. 7,003,251, and further is based upon and claims the benefit of priority from the prior Japanese Patent Application No. 2002-125544, filed Apr. 26, 2002, the entire contents of each of which are hereby incorporated herein by reference.

BACKGROUND OF THE INVENTION

1. Field of the Invention

The present invention relates to an electrophotographic image forming apparatus and more particularly to an electrophotographic image forming apparatus of the type capable of forming color images on both sides of a single recording medium substantially at the same time without turning it over.

2. Description of the Background Art

An image forming apparatus of the type described is disclosed in, e.g., Japanese Patent Laid-Open Publication No. 2000-250272. The apparatus taught in this document includes tandem image forming stations each being assigned to a particular color. A first belt or first intermediate image transfer body is held in contact with four photoconductive elements arranged side by side at the consecutive image forming stations. A second belt or second intermediate image transfer body is movable into and out of contact with the first belt. Toner images of different colors are formed on the photoconductive elements in accordance with image data representative of the first side of a document and then transferred to the first belt one above the other, completing a color toner image. The color toner image is then thermally transferred from the first belt to the second belt by heating means associated with the first belt. Subsequently, toner images of different colors are again formed on the photoconductive elements in accordance with image data representative of the second side of the same document and then transferred to the first belt one above the other, forming another color toner image. When a sheet or recording medium is conveyed to a nip between the first and second belts, the color toner images carried on the first and second belts are thermally transferred to and fixed on opposite sides of the sheet at the same time by the heating means.

The conventional image forming apparatus described above is undesirable from the energy saving standpoint because it includes, in addition to the heating means, cooling means for cooling the toner image on the first or the second belt or the toner images on the sheet to temperature below the softening point of toner and protecting the image forming stations from thermal damage. Moreover, the first belt is not cleaned after the image transfer to the sheet. It is therefore likely that color tone is degraded during the next image forming cycle when, e.g., image transfer efficiency is lowered due to the variation of environmental conditions or similar cause.

SUMMARY OF THE INVENTION

It is an object of the present invention to provide an image forming apparatus capable of forming color images on both sides of a sheet at the same time while enhancing energy saving, productivity and efficient image transfer and fixation.

An image forming method of the present invention begins with a first image transfer step for thermally transferring a first toner image from a first image carrier to a second image carrier contacting it. Subsequently, in a second image transfer step, the first toner image carried on the second image carrier and a second toner image newly formed on the first image carrier are thermally transferred to opposite sides of a recording medium substantially at the same time. Higher image transfer temperature is assigned to the second image transfer step than to the first image transfer step.

An apparatus for practicing the above image forming method is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
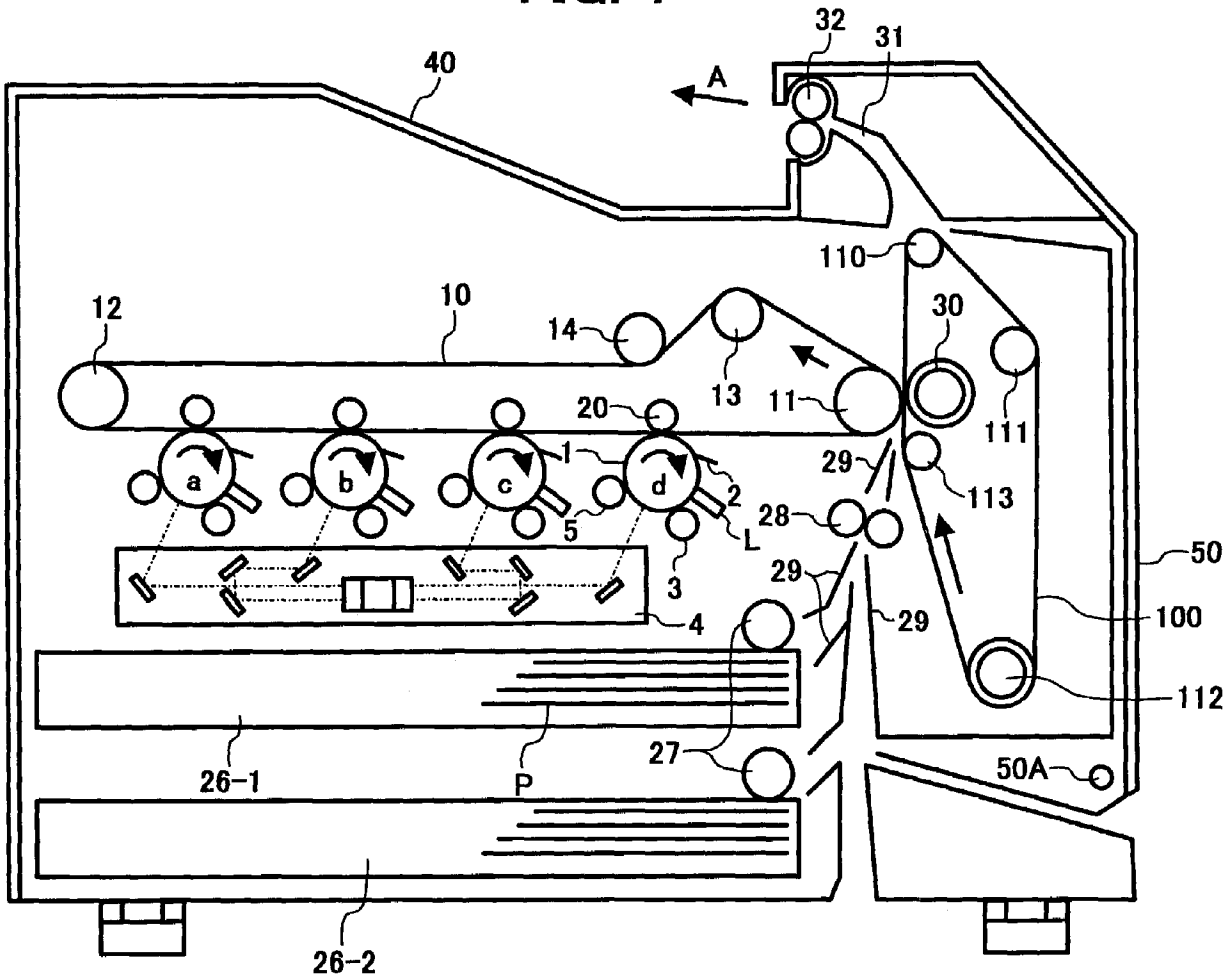
FIG. 1 is a section showing a first embodiment of the image forming apparatus in accordance with the present invention.

Referring to FIG. 1 of the drawings, a first embodiment of the image forming apparatus in accordance with the present invention is shown. As shown, the image forming apparatus includes sheet feeding devices 26-1 and 26-2 each being loaded with a stack of sheets P. A pickup roller 27 assigned to each of the sheet feeding devices 26-1 and 26-2 feeds the top sheet P toward a registration roller pair 28 via a plurality of guides 29.

A latent image carrier is implemented as a photoconductive drum 1 rotatable in a direction indicated by an arrow in FIG. 1. Arranged around the drum or latent image carrier 1 are a quenching lamp L, a drum cleaner 2, a charger 3, and a developing unit 5. A space to which optical information output from an exposing unit 3 is input exists between the charger 3 and the developing unit 5. In the illustrative embodiment, four drums 1 (a, b, c and d) are arranged side by side. Arrangements around the four drums a through d are identical except for the color of toner stored in the developing unit 5.

Each drum 1 may be implemented as an aluminum drum having a diameter of about 30 mm to about 100 mm and on which an organic photoconductor layer is formed. Alternatively, an amorphous silicon layer may be formed on the surface of the drum 1. The drum 1 may be replaced with a photoconductive belt, if desired.

The exposing unit 4 uses a conventional laser scheme and scans the uniformly charged surface of each drum 1 in accordance with image data of a particular color, thereby forming a latent image on the drum 1. The exposing unit 4 may use an LED (Light Emitting Diode) array and focusing means, if desired.

Part of the drum or latent image carrier 1 is held in contact with a first image carrier 10. The first image carrier 10 is implemented as an endless belt passed over rollers 11, 12 and 13 and playing the role of a primary intermediate image transfer body. The first image carrier (belt hereinafter) 10 includes a base implemented by a 20 μm to 600 μm thick resin film or rubber and has electric resistance that allows toner to be electrostatically transferred from the drum 1 to the belt 10.

Four, primary image transferring means 20 are positioned between the opposite runs of the belt 10, and each faces one of the drums 1. In the illustrative embodiment, each primary image transferring means 20 is implemented as an image transfer roller to which a high voltage is to be applied although it may be implemented as a charger including a discharge electrode. Toner images of different colors formed on the drums 1 are sequentially transferred to the belt 10 one above the other by the image transfer rollers 20, completing a color toner image on the belt 10.

Among the rollers 11 through 13 supporting the belt 10, the roller 11 accommodates a heating body, not shown, and plays the role of image transferring means A. The other roller 12 or 13 or an additional roller, not shown, is provided with tension applying means, not shown, for applying tension to the belt 10. The rollers other than the image transfer rollers 20 are grounded.

A second image carrier 100 is positioned at the right-hand side of FIG. 1 and partly held in contact with the belt or primary intermediate image transfer body 10. The second image carrier 100 is also implemented as an endless belt passed over rollers 110, 111, 112 and 113 and movable in a direction indicated by an arrow in FIG. 1. The second image carrier 100 plays the role of a secondary image transfer body and will be simply referred to as a belt 100 hereinafter. The belt 100 includes a base implemented as a 20 μm to 600 μm thick resin film or rubber.

An image transfer roller 30 is disposed in the loop of the belt 100 in the vicinity of the roller 11, or image transferring means A, and constitutes image transferring means B. In the illustrative embodiment, the rollers or image transferring means 11(A) and 30(B) both are implemented as thermal image transferring means for the following reason. Generally, in an electrostatic image transfer system, image transfer is successful so long as it is effected at a position where a sheet and an image carrier closely contact each other. However, in part of an image transfer zone where the sheet and image carrier do not closely contact each other, an image is blurred or otherwise disfigured due to discharge ascribable to contact and separation as well as an electric field. To solve this problem, in the illustrative embodiment, an electric field is not applied to either one of the rollers 11 and 30. More specifically, image transfer from the belt 10 to the belt 100 and image transfer from the belts 10 and 100 to the sheet P are effected by heat, as will be described in detail hereinafter.

In operation, toner images of different colors formed on the drums or latent image carriers 1 are electrostatically transferred to the belt or primary image transfer body 10 one above the other by the image transfer rollers or primary image transferring means 20, completing a first color toner image on the belt 10. The first color toner image thus formed is thermally transferred from the belt 10 to the belt or secondary image transfer body 100 by the rollers 11 and 30.

Subsequently, toner images of different colors are again formed on the drums 1 and then electrostatically transferred to the belt 10 one above the other, completing a second color toner image on the belt 10. When the sheet P is conveyed to a nip between the belts 10 and 100, the first and second color toner images carried on the belts 100 and 10, respectively, are transferred to opposite sides of the sheet P by the rollers 11 and 30 while being fixed on the sheet P at the same time. Consequently, the sheet P becomes a duplex or two-sided color print.

A temperature control mechanism is associated with the rollers 11 and 30, i.e., image transferring means A and B. The temperature control mechanism varies temperature from an image transfer step a from the belt 10 to the belt 100 to an image transfer step b from the belts 10 and 100 to the sheet P. More specifically, the image transfer step a needs only heat that can simply cause toner on the belt 10 to soften and plastically deform and be transferred to the belt 100. On the other hand, the image transfer step b needs more heat than the image transfer step a because it should melt toner on both of the belts 10 and 100 and transfer it to the sheet P. The temperature control mechanism therefore controls the temperature of the rollers 11 and 30 in such a manner as to effect the image transfer step b at higher temperature than the image transfer step a. This condition saves more energy than a condition wherein heat is maintained constant.

At least the belt 100, as distinguished from the belt 10, should preferably be formed of a heat-resistant material, e.g., polyimide or polyamide. The heat-resistant material allows the belts 10 and 100 to remain stable despite that they are subject to high temperature. This is particularly true with the belt 100 that conveys the hot sheet P carrying the toner melted in the image transfer step b thereon.

The belts 10 and 100 each should preferably be provided with a parting layer on the surface thereof. The parting layer may advantageously be formed of fluorocarbon resin by way of example, so that the toner can be easily parted from the belt and desirably fixed on the sheet P.

Further, to enhance image transferability from the belt 10 to the belt 100 in the first image transfer step a, the belt 100 should preferably be provided with greater surface roughness than the belt 10 for the following reason. For example, assume that toner is nipped between two belts different in surface roughness from each other, and that temperature high enough to melt the toner and preselected pressure are applied. Then, the toner between the belts plastically deforms and bites into the surface of one belt rougher than the surface of the other belt. The surface roughness Rz of the belt 10 should preferably be between 1 μm and 4 μm while the surface roughness Rz of the belt 100 should preferably be between 5 μm and 10 μm. In addition, the contact angle of the belt 100 should preferably be smaller than the contact angle of the belt 10. A contact angle is generally used as an index relating to the parting ability of toner.

As stated above, after the toner image has been transferred from the belt 10 to the belt 100 in the image transfer step a, it penetrates, in the image transfer step b, into gaps between the fibers of the sheet P whose surface roughness Rz is as great as 20 μm to 40 μm and deposits on the sheet P because of an anchor effect. In this manner, the image transfer steps a and b both can be efficiently effected.

Figure 2:
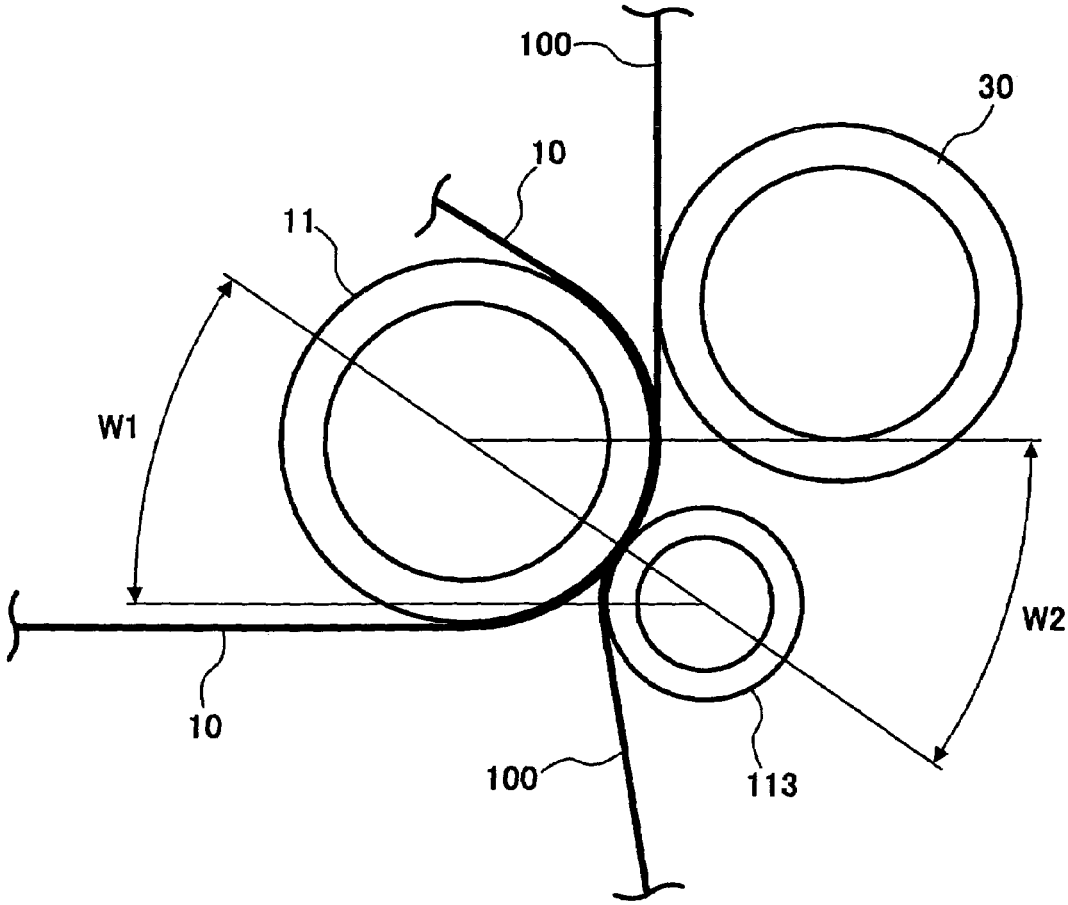
FIG. 2 is an enlarged view showing a nip between a first and a second intermediate image transfer body included in the illustrative embodiment.

Reference will be made to FIG. 2 for describing the nip between the belts 10 and 100 specifically. As shown, the roller 30 and a roller 113 positioned upstream of the roller 30 in the direction of sheet conveyance press the belt 100 toward the roller 11, thereby maintaining the belt 100 in contact with the belt 10. The nip refers to the zone where the belt 100 contacts the rollers 113, 11 and 30.

As for the configuration of the nip, paying attention to the belt 100, the belt 100 is passed over the rollers 113 and 11 by angles W1 and W2, respectively. Also, the belt 100 is held in contact with the roller 30 at a position downstream of the roller 11 in the direction of sheet conveyance. While the above angles W1 and W2 and curvatures, which are mainly determined by the diameters of the rollers 11 and 113, are open to choice, the nip should preferably be configured such that when the sheet P carrying the toner melted by the rollers 10 and 30 leaves the nip, it is parted from the belt 10 and conveyed along the belt 100 without fail. This allows the toner to be surely fixed on the sheet P.

A greater fixing effect is achievable if the angle by which the belt 100 is passed over the roller is increased. However, consideration should be given to the fact that when the sheet P is relatively thick or rigid, the sheet conveying ability is lowered when the sheet P is bent at the nip.

Further, the roller 113 upstream of the roller 30 should also preferably accommodate a heater or similar heating means. With the heating means, the roller 113 can heat the belt 100 before image transfer and therefore allows the toner to be more efficiently heated, transferred, and fixed.

To protect the formation of a latent image, development and electrostatic, primary image transfer from the heat generated around the nip stated above, the illustrative embodiment further includes the following arrangements. Cooling means is assigned to the belt 10 and positioned downstream of the roller 11 in the direction of belt movement, but upstream of the drums 1 arranged along the belt 10. From the efficiency standpoint, one of the rollers supporting the belt 10, particularly a roller 14, FIG. 1, should preferably be implemented as a heat pipe. As shown in FIG. 1, the roller 14 is positioned outside of the loop of the belt 10 while the belt 10 is passed over the roller 14 by a preselected angle, so that the loop of the belt 10 is deformed inward. In this configuration, the roller or heat pipe 14 and belt 10 can contact each other over a broad area, enhancing the cooling effect.

As for the belt 100, cooling means is positioned downstream of the roller 113 having the heating means in the direction of belt movement, but upstream of the nip between the belts 10 and 100. Again, one of the rollers supporting the belt 100 should preferably be implemented as a heat pipe. In FIG. 1, it is most desirable to assign the cooling function to a roller 112.

A second embodiment of the present invention will be described with reference to FIG. 3. Briefly, the illustrative embodiment includes cleaning means for one or both of the belts 10 and 100 in addition to the structural elements of the previous embodiment. The cleaning means obviates an occurrence that if toner is left on the belt 10 or 100 after image transfer, then the toner smears the next sheet P or accumulates on the belt 100 to thereby degrade the-characteristics of the belt 100.

Figure 3:
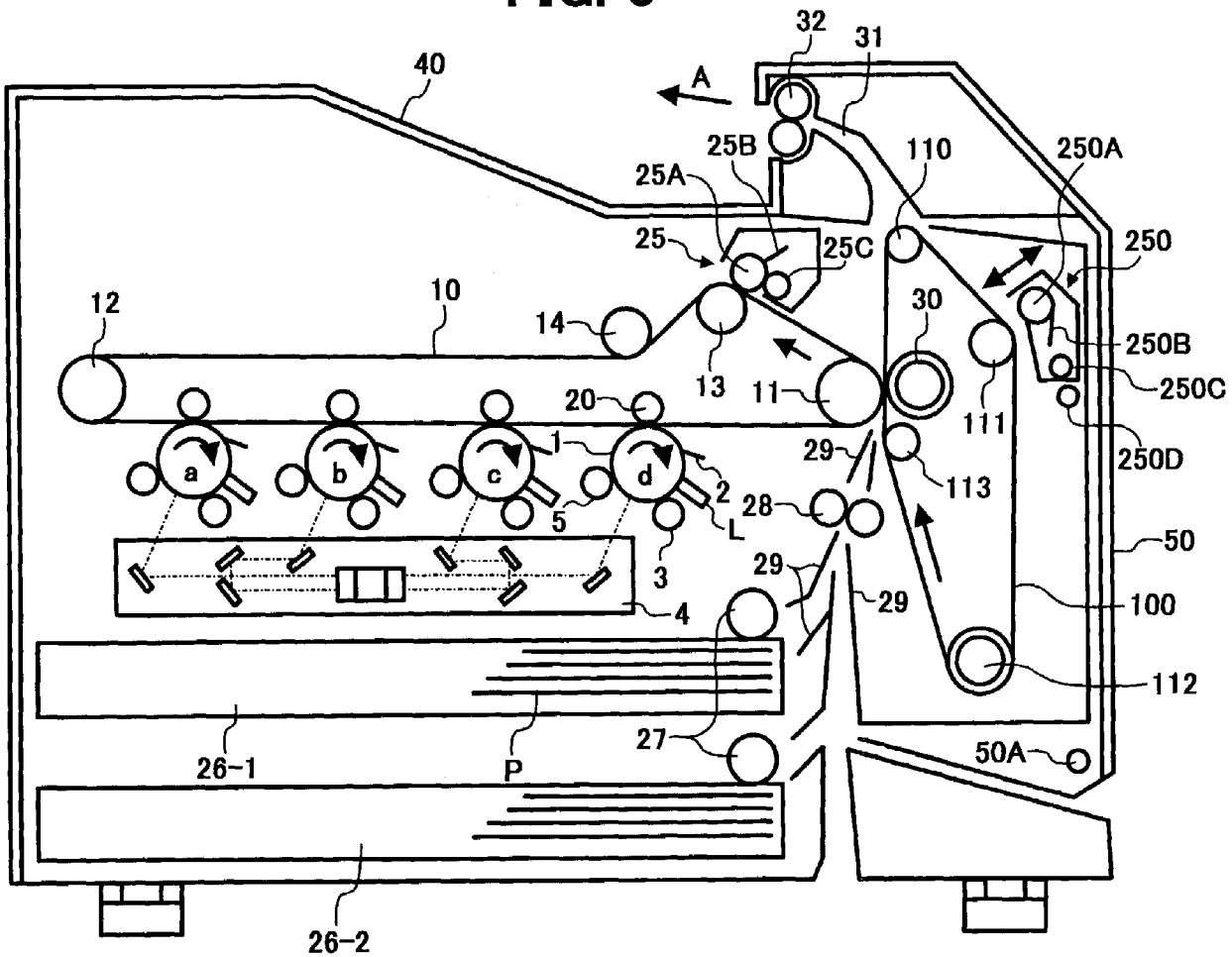
FIG. 3 is a section showing a second embodiment of the image forming apparatus in accordance with the present invention.

As shown in FIG. 3, cleaning means 25 for the belt 10 is positioned downstream of the nip between the belts 10 and 100 in the direction of belt movement, but upstream of the drums 1. Also, cleaning means 250 for the belt 100 is positioned downstream of the above nip in the direction of belt movement, but upstream of the roller or heat pipe 112. The cleaning means 25 scrapes off toner left on the belt 10 with a cleaning roller 25A, removes the toner from the roller 25A with a blade 25B, and then conveys the toner to a storing portion, not shown, with collecting means 25C. Likewise, the cleaning means 250 scrapes off toner left on the belt 100 with a cleaning roller 250A, removes the toner from the roller 250A with a blade 250B, and then conveys the toner to a storing portion, not shown, with collecting means 250C.

The cleaning rollers 25A and 250A each should preferably be formed of copper, aluminum or similar material having high thermal conductivity and should preferably have greater surface roughness than the belt 10 or 100 associated therewith for the same reason as stated earlier in relation to the belts 10 and 100. With the cleaning rollers 25A and 250A, it is possible to efficiently remove toner melted and left on the belts 10 and 100 without causing it to solidify.

If desired, the cleaning rollers 25A and 250A each may also accommodate a respectively heater so as to melt toner left on the belt 10 or 100, facilitating the removal of toner from the belt 10 or 100.

In the illustrative embodiment, impurity collecting means is disposed on the sheet path upstream of the nip between the belts 10 and 100 in the direction of sheet conveyance. Generally, when the sheet P is conveyed, impurities including paper dust and sizing materials, which are added to the sheet P on a production line, are produced from the sheet P. If such impurities are conveyed, to the surface of the belts 10 and 100, then it is likely that the impurities are fixed on the sheet P together with toner to thereby prevent a desired tone from being achieved or that they accumulate on the surfaces of the belts 10 and 100 to thereby deteriorate the belts 10 and 100.

While the impurity collecting means may be associated with any one of the rollers upstream of the nip for image transfer in the direction of sheet conveyance, it should preferably be associated with the registration roller pair 28 just preceding the nip. The impurity collecting means maybe any one of, e.g., applying a charge to the roller, charging the roller by triboelectrification, and using rubber for the roller. Further, a blade 28C or a brush, for example, may be associated with the roller so as to scrape off the impurities collected by the roller.

The arrangement of various structural elements unique to the present invention will be described hereinafter. It is preferable to position the belt or primary intermediate image transfer body 10 such that its longitudinal surfaces extend substantially horizontally, and to hold the drums or latent image carriers 1 in contact with one of the above longitudinal surfaces, as stated earlier with reference to FIGS. 1 and 3. This successfully obviates a dead space in the apparatus and therefore makes the entire apparatus compact. The roller 11, or image transferring means A, is positioned at one end of the belt 10 and held in contact with the belt or secondary image transfer body 100.

The drums 1 should preferably contact the lower run of the belt 10 in order to reduce the first print time for thereby enhancing productivity, compared to a case wherein the drums 1 contact the upper run of the belt 10. Further, such an arrangement optimizes the configuration and arrangement of the belt 10 to thereby allow the drums 1 to be positioned in a well-balanced condition.

Furthermore, it is preferable to arrange a path for sheet conveyance from the sheet cassettes 26-1 and 26-2 toward the upper portion of the apparatus body upward, to arrange the belt 100 in the up-and-down direction, and to locate a print tray 40 above the belt 100, so that the sheet P can be driven out to the print tray 40 with the image transferred thereto from the belt 10 facing downward. This configuration reduces the length of the above path and therefore the recording time and allows consecutive prints P to be easily processed in order of page, i.e., from the first page to the last page.

Figure 4:
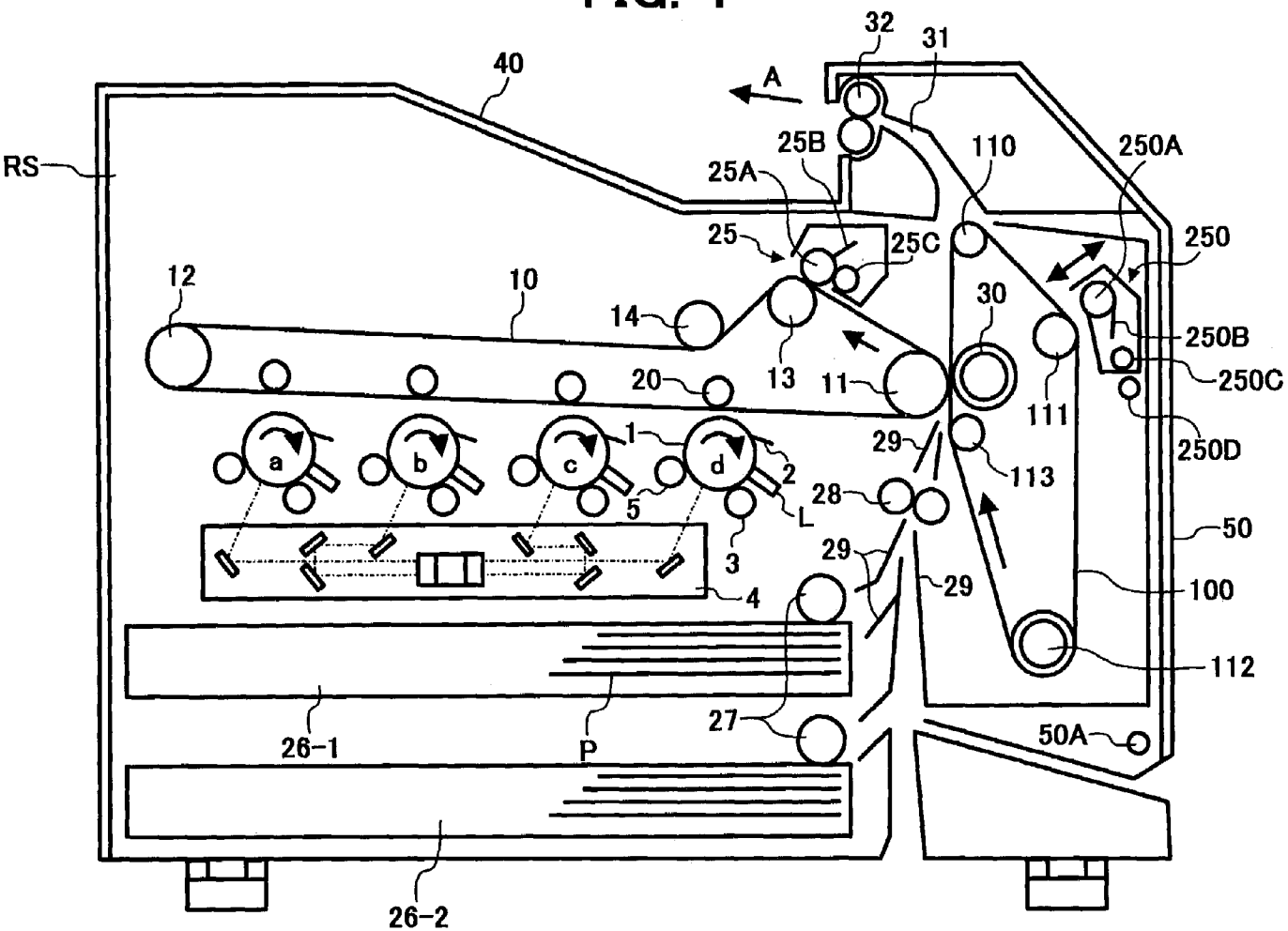
FIG. 4 is a section showing a third embodiment of the image forming apparatus in accordance with the present invention.

FIG. 4 shows a third embodiment of the present invention additionally including arrangements for facilitating maintenance. As shown, the entire unit including the belt 10 and rollers supporting it is angularly movable, or retractable, clockwise about the roller 11 into a space RS available in the apparatus body. It is noteworthy that the roller 14 with cooling means deforms the belt loop inward, as stated previously, and therefore makes the belt loop compact for thereby broadening the spaced RS. By releasing the belt 10 included in the above unit from the drums 1, it is possible to mount or dismount the charger 3, developing unit 5 and other process units as well as a unit including the belt 10. Such releasing means allows the drums and belt 10 to be mounted or dismounted without interfering with each other and therefore without any damage or contact.

Figure 5:
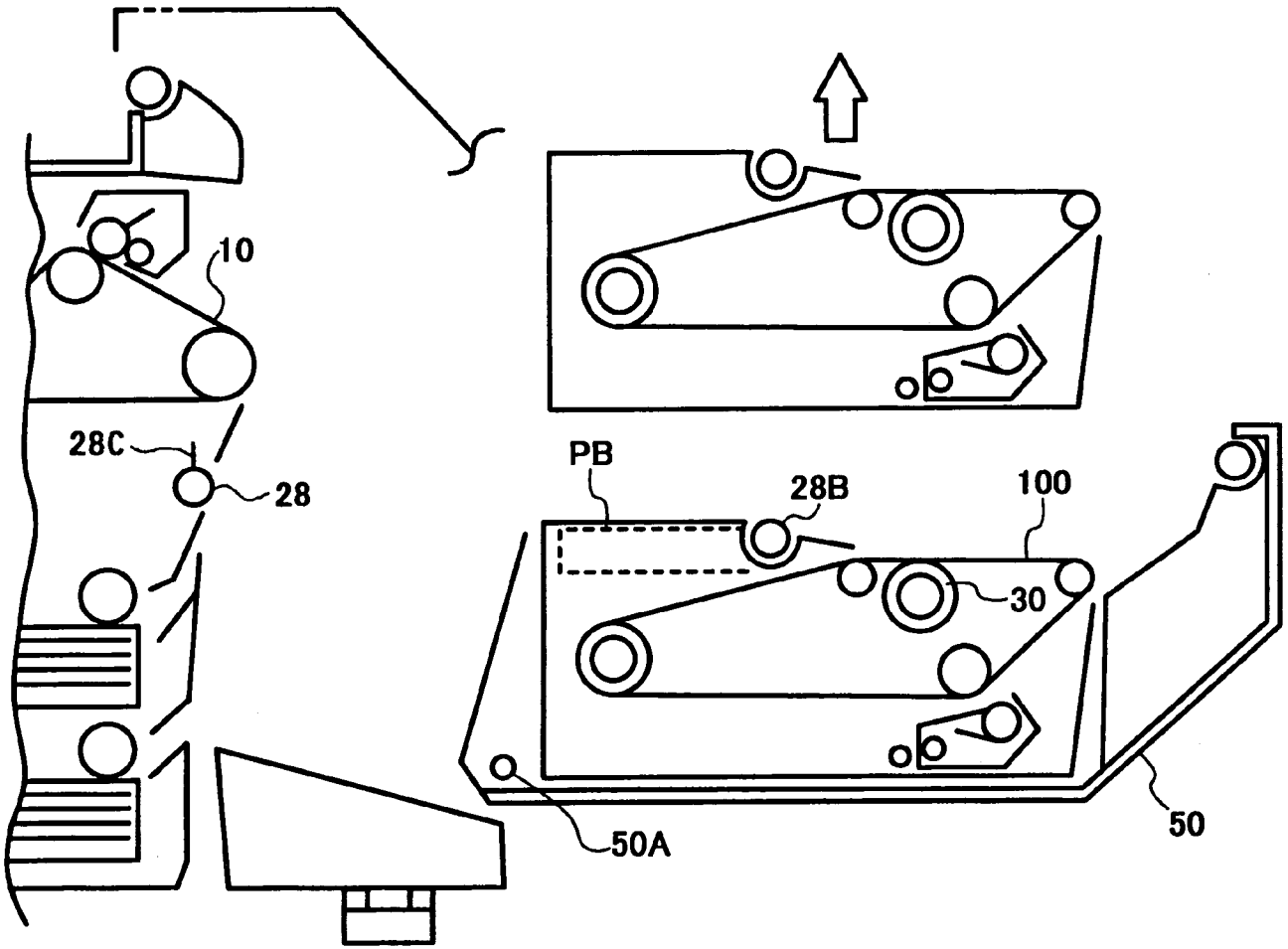
FIG. 5 is a section showing a fourth embodiment of the image forming apparatus in accordance with the present invention in a partly opened position.

FIG. 5 shows a fourth embodiment of the present invention in a partly open position. As shown, part of the apparatus body is implemented as a frame 50 angularly movable, or openable, about a shaft 50A. A unit including the belt or secondary image transfer body 100 is mounted on the frame 50, so that the belt 100 is moved away from the belt 10 when the frame 50 is opened. As a result, the sheet conveyance path between the belts 10 and 100 is easily accessible for jam processing or maintenance. In addition, after the frame 50 has been so opened, the unit including the belt 100 can be bodily mounted or dismounted substantially in the up-and-down direction, as indicated by an arrow in FIG. 5, and can therefore be easily replaced or maintained.

The unit including the belt 100 may additionally include one 28B of the registration rollers 28, so that the impurity collecting means can be maintained at the same time as the above unit. Further, the frame 50 maybe loaded with a container PB for collecting the impurities removed by the impurity collecting means, so that the collected impurities can be discarded when the frame 50 is opened.

Figure 6:
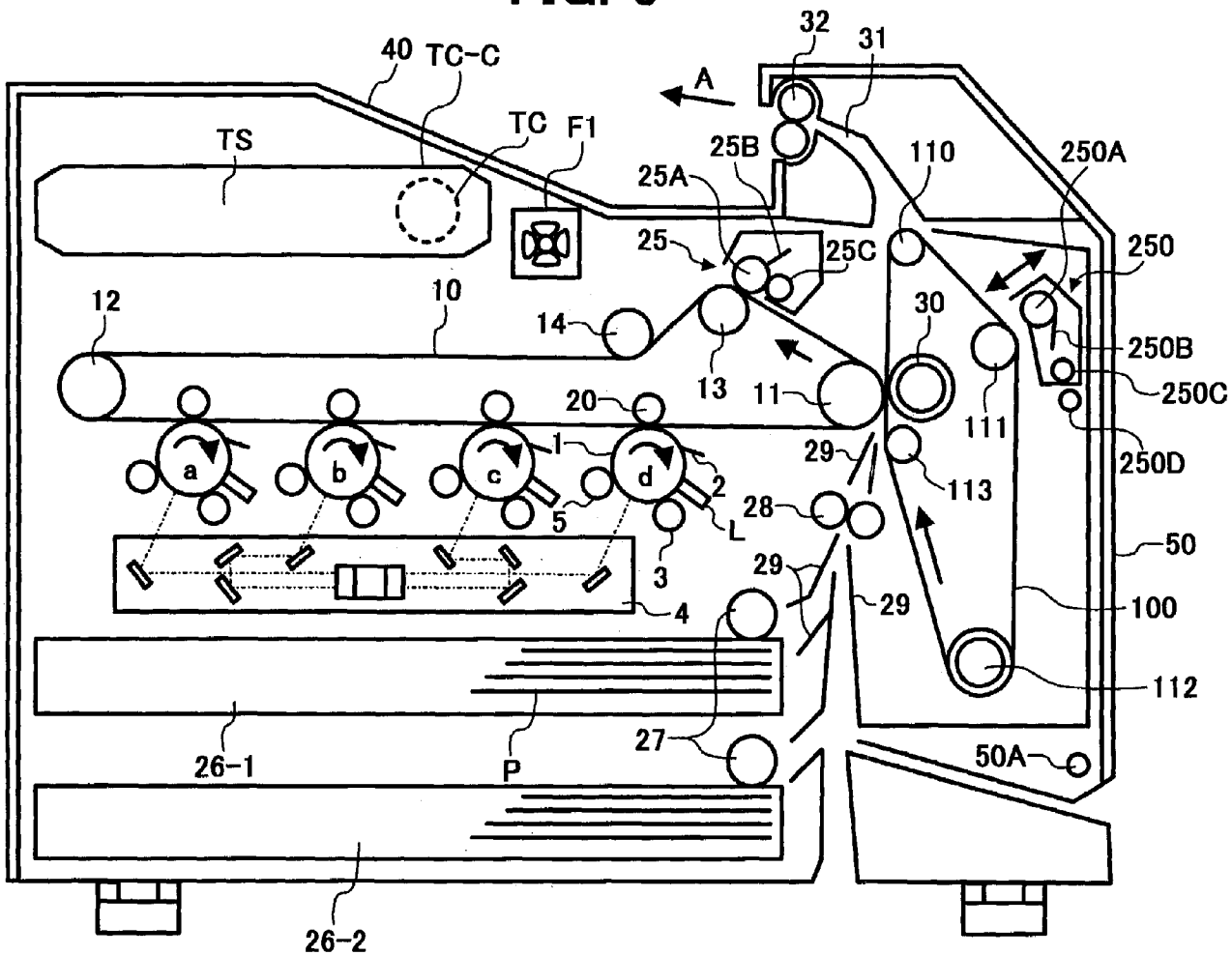
FIG. 6 is a section showing a fifth embodiment of the image forming apparatus in accordance with the present invention.

FIG. 6 shows a fifth embodiment of the present invention additionally including a toner storing section TS arranged below the print tray 40 and capable of storing fresh toner to be replenished. More specifically, different colors of toner each being assigned to one of the developing units 5 around the drums 1 are stored in toner cartridges TC. A powder pump, for example, is used to replenish such fresh toner to each of the developing units 5.

Protecting means for protecting the fresh toner from heat generated inside the apparatus body is also included in the illustrative embodiment. The protecting means may be implemented as a heat insulating member W intervening between the toner storing section TS and the roller or heat source 30. For the heat insulating member W, use may be made of resin with or without fur implanted thereon or a laminate structure including an air layer. Alternatively, an air passage communicated to a fan F1 may be arranged to suck outside air. Further, the toner cartridges TC may be accommodated in a heat insulating casing TC-C formed of, e.g., form, wool, felt, resin, wood fibers or glass fibers. Two or more of such protecting means should preferably be combined.

Figure 7:
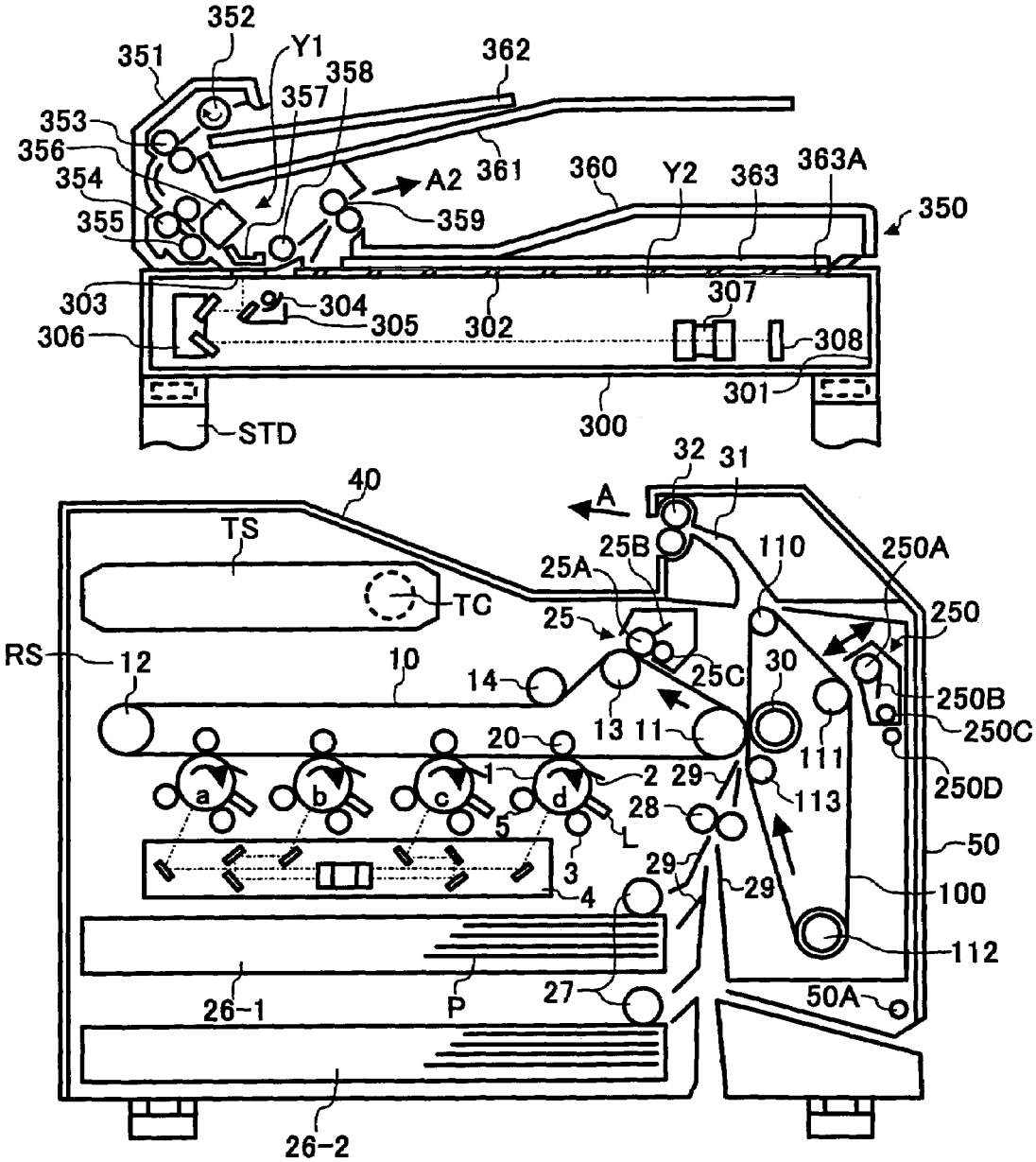
FIG. 7 is a section showing an image forming apparatus including a document reading device and an ADF (Automatic Document Feeder)

The prevent invention may further include a scanner or document reading device and an ADF, as will be described with reference to FIG. 7 hereinafter. As shown, glass platens 302 and 303 are mounted on the top of a frame 301. A first carriage 305 loaded with a light source 304 and a mirror and a second carriage 306 loaded with mirrors are disposed in the frame 301 and movable in a direction parallel to the glass platen 302. The second carriage 306 is implemented as conventional optics movable at a speed which is one half of the speed of the first carriage 305. When the light source 304 illuminates a document, the resulting imagewise reflection is incident to a CCD (Charge Coupled Device) image sensor 308 via a lens 307. The resulting data output from the CCD image sensor 308 is digitized and then sent to a remote station by facsimile or printed out by the image forming apparatus positioned below the scanner or sent to a host computer.

An ADF 350 includes a cover plate 363 and is openable upward away from the glass platens 302 and 303. When the ADF 350 is closed, the cover plate 363 can press even a book or similar thick document downward. A stack of documents having several pages may be set on a movable plate 362 positioned on a document tray 361, the first page facing upward on the top of the stack. When a pickup roller 362 is rotated in a direction indicated by an arrow in FIG. 7, it pays out the top document to a path 351. At this instant, a reverse roller 353 surely separates the top document from the underlying documents. The document thus paid out is conveyed to an outlet roller pair 359 via rollers 354, 355 and 358 in a direction indicated by an arrow A2 and then driven out to a tray 360 with the first page facing downward.

Before the document is driven out to the tray 360, an image sensor 356 reads the second page of the document. Subsequently, the optics mentioned earlier reads the first page of the document being conveyed between the cover plate 357 and the glass platen 303. It is to be noted that the first and second carriages 305 and 306 are held stationary when the document is read via the glass platen 303. In this manner, the opposite sides of a single document are sequentially read at two shifted positions by one time of conveyance.

A white sheet 363A is fitted on the portion of the cover plate 363 expected to face a document in light of the fact that, if an extremely thin document is used, then the reading means is apt to read the color of the cover plate 363 as background via the document. This is also true with the roller 355 and a pressing plate 357.

Figure 8:
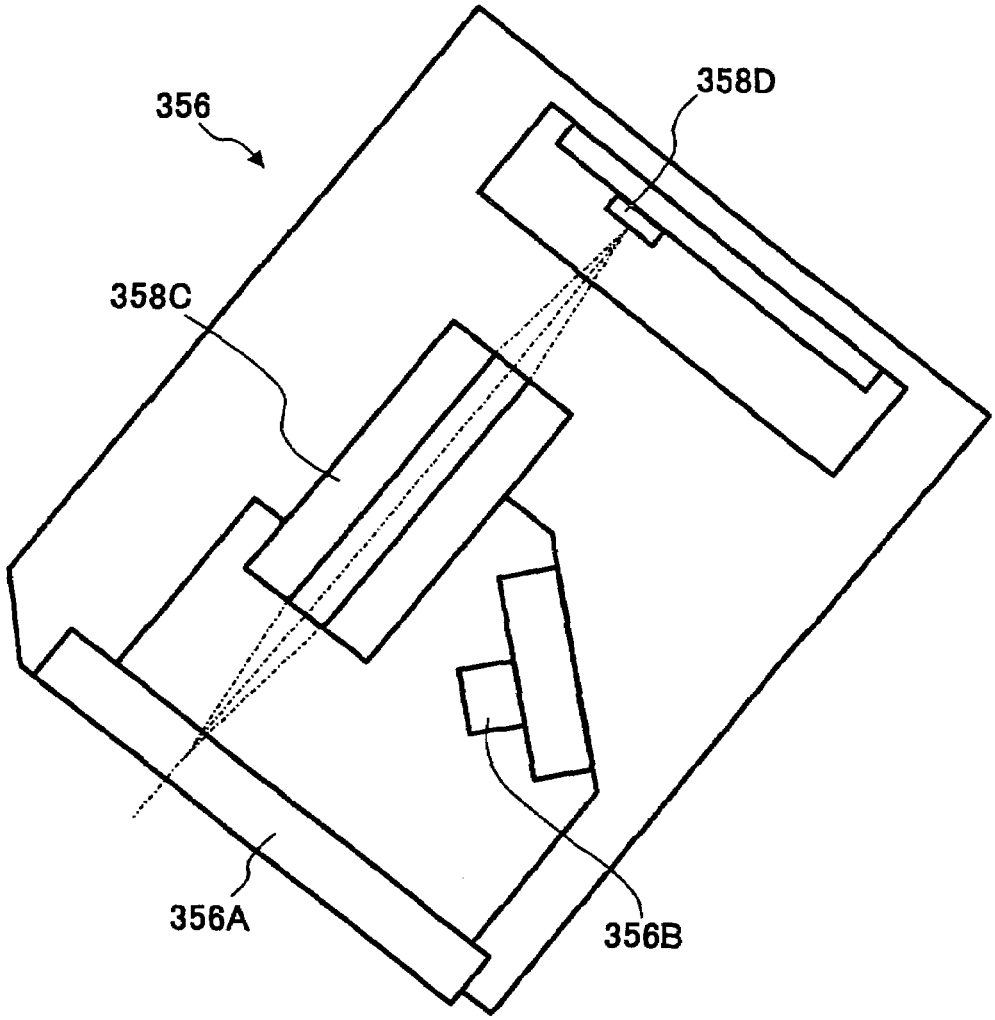
FIG. 8 is a section showing a specific configuration of an image sensor.

FIG. 8 shows the image sensor 356 in a section. As shown, the image sensor 356 includes a glass 356A expected to face a document, an LED array or similar light source 356B, a lens array or focusing device 356C, and an equi-magnification sensor 356D. Any other suitable type of image sensor, e.g., a contact sensor not including a lens may be used, if desired.

Let the reading position where a document is read while being conveyed and the reading position where the carriages 305 and 306 read a document be referred to as a first and a second reading position Y1 and Y2, respectively. When a book or similar thick document is set on the glass platen 302, the ADF 350 is closed to press the document with the cover plate 363. At this instant, the first reading position Y1 included in the ADF body is raised with the result that the glass platen 303 is moved away from the pressing plate 357. In light of this, a sensor, not shown, is used to sense a condition wherein the pressing plate 357 is moved away from the glass platen 303. When the sensor senses such a condition, the first reading position Y1 is inhibited from being used. This prevents a sheet document from being read despite that a book is present on the glass platen 303.

Further, assume that urgent reading or urgent image formation is desired, and when a sheet document is present on the document tray or the tray 360. Then, the second reading position Y2, i.e., the glass platen 302 and pressing plate 363 can be used in an interrupt mode input on an operation panel not shown.

The operation of the image forming apparatus in accordance with the present invention will be described hereinafter. A laser beam issuing from the exposing unit 4 is incident to, among the drums 1 uniformly charged by the respective chargers 3, the drum a for thereby forming a latent image in accordance with image data of a particular color. The developing unit 5 develops the latent image to thereby produce a corresponding toner image on the drum a. Subsequently, the image transfer roller or primary image transferring means 20 transfers the toner image from the drum a to the belt or primary intermediate image transfer body 10. More specifically, in the illustrative embodiments, the toner deposited on the drum 1 is of negative polarity, so that a positive charge is applied to the image transfer roller 20. After the image transfer, the drum cleaner 2 cleans the surface of the drum a, and then the quenching lamp L discharges the drum a to thereby prepare the it for the next image forming cycle.

The belt 10 carrying the toner image thereon is moved in a direction indicated by an arrow. A latent image corresponding to another color is formed on the next drum b and then developed by toner of another color to become a toner image. Subsequently, the toner image is transferred to the belt 10 over the previous toner image present on the belt 10. Such a procedure is repeated four times to form a color or four-color toner image on the belt 10.

The color image so completed on the belt 10 is thermally transferred to the belt or secondary image transfer body 100, which is moving in synchronism with the belt 10. At this instant, the sheet P does not exist between the belts 10 and 100. Therefore, heat that simply allows the toner to soften and move from the belt 10 to the belt 100 is applied to the rollers 11, 30 and 113.

As soon as the belt 10 reaches a preselected position, a toner image to be transferred to the other side of the sheet P is formed by the procedure described above. At the same time, the sheet P starts being paid out from the sheet feeding device 26-1 or 26-2. More specifically, the pickup roller 27, rotating counterclockwise, pays out the top sheet P from associated one of the sheet feeding devices 26-1 and 26-2 toward the registration roller pair 28. The registration roller pair 28 once stops the sheet P and then drives it at preselected timing. At the nip between the drums 10 and 100, the toner image carried on the belt 10 and the toner image carried on the belt 100 are thermally transferred to opposite sides of the sheet P. At this instant, the rollers 11, 30 and 113 generate more heat than when the sheet P is absent at the above nip.

The sheet P carrying the toner images on both sides thereof is conveyed upward, separated from the belt 100 by the curvature of the roller 110, and then driven out to the print tray 40 by the outlet roller pair 32.

Assume that the sheet P is driven out to the print tray 40 with its side to which the toner image is transferred later, i.e., directly transferred from the belt 10 facing downward. Then, to stack consecutive sheets P on the print tray 40 in order of page, an arrangement may be made such that after the image of the second page has been formed and then transferred to the belt 100, the image of the first page is directly transferred from the belt 10 to the sheet P. In such an arrangement, exposure is effected such that the image to be transferred from the belt 10 to the sheet P is a non-inverted image on each drum 1 while the image to be transferred from the belt 100 to the sheet P is an inverted image or mirror image on the drum 1. For this purpose, image data stored in a memory may be processed to implement the non-inverted and inverted images as conventional.

After the image transfer from the belt 100 to the sheet P, the cleaning means 250 removes the toner left on the belt 100. In FIG. 3, the cleaning device 250 is angularly movable about a fulcrum 250D toward and away from the belt 100. More specifically, the cleaning device 250 is released from the belt 100 when the toner image to be transferred to the sheet P is present on the belt 100, and then turned clockwise into contact with the belt 100 when cleaning is necessary.

In a simplex print mode, while an image may be formed by either one of two different methods, it is simpler to transfer an image from the belt 10 to the sheet P than to transfer the former to the latter by way of the belt 100.

Various modifications will become possible for those skilled in the art after receiving the teachings of the present disclosure without departing from the scope thereof.

What is claimed is:

1. An image forming apparatus comprising:

a first image carrier on which a toner image is to be formed in accordance with image data;

a belt comprising a second image carrier contacting said first image carrier and to which the toner image is to be transferred from said first image carrier, wherein said belt is mounted on a movable frame so as to be selectively movable away from said first image carrier;

image transferring means for transferring the toner image from said first image carrier to said second image carrier and for transferring the toner image carried on at least one of said first image carrier and said second image carrier to a recording medium, which is conveyed on a path to a nip between said first image carrier and said second image carrier, wherein said image transferring means comprises thermal image transferring means and comprises a temperature control mechanism; and impurity collecting means positioned on said path for collecting impurities produced from the recording medium, wherein said impurity collecting means is associated with a pair of registration rollers which stop the recording medium for a moment to thereby synchronize said recording medium to the toner image, and wherein one of said registration rollers mounted to be movable with said belt.

* * * * *